US009186807B2

(12) United States Patent
Wallom et al.

(10) Patent No.: US 9,186,807 B2
(45) Date of Patent: Nov. 17, 2015

(54) DEVICE FOR FORMING A PATTERN IN A SHEET MATERIAL

(75) Inventors: Michael D. Wallom, Madison, WI (US); Daniel Cunningham, Edgerton, WI (US); Colin Roberts, Stevens Point, WI (US); Daniel J. Lipscomb, Prairie Du Sac, WI (US); Douglas Nelson, Madison, WI (US); Andrew P. Block, Middleton, WI (US); Scott Roelke, Marshall, WI (US)

(73) Assignee: Fiskars Brands, Inc., Madison, WI (US)

( * ) Notice: Subject to any disclaimer, the term of this patent is extended or adjusted under 35 U.S.C. 154(b) by 748 days.

(21) Appl. No.: 13/366,656

(22) Filed: Feb. 6, 2012

(65) Prior Publication Data

US 2013/0199384 A1 Aug. 8, 2013

(51) Int. Cl.
*B26F 1/36* (2006.01)
*B26F 1/40* (2006.01)
(Continued)

(52) U.S. Cl.
CPC . *B26F 1/36* (2013.01); *B26F 1/405* (2013.01); *B41K 3/02* (2013.01); *B41K 3/36* (2013.01); *B44B 5/0038* (2013.01); *B44B 5/0085* (2013.01); *B26D 7/2628* (2013.01); *B26D 2007/0087* (2013.01); *Y10T 83/7493* (2015.04); *Y10T 83/8743* (2015.04); *Y10T 83/883* (2015.04); *Y10T 83/8828* (2015.04); *Y10T 83/8831* (2015.04)

(58) Field of Classification Search
CPC ..... B26D 1/14; B26D 1/205; B26D 7/2628; B26D 2007/0087; B26F 1/36; B26F 1/405; B41K 3/02; B41K 3/36; B44B 5/0038; B44B 5/0085; Y10T 83/7493; Y10T 83/8743; Y10T 83/8828; Y10T 83/883; Y10T 83/8831
USPC ..... 83/684–691, 560, 633, 618–620, 628, 83/150
See application file for complete search history.

(56) References Cited

U.S. PATENT DOCUMENTS 3,073,199 A 1/1963 Yerkes
4,594,927 A 6/1986 Mori
(Continued)

FOREIGN PATENT DOCUMENTS

EP 1741526 1/2007

OTHER PUBLICATIONS

U.S. Appl. No. 29/404,451, filed Oct. 20, 2011, Michael D. Wallom.
(Continued)

*Primary Examiner* — Kenneth E. Peterson
*Assistant Examiner* — Nhat Chieu Do
(74) *Attorney, Agent, or Firm* — Foley & Lardner LLP

(57) ABSTRACT

A device for forming a pattern in a sheet of material is provided. The device includes a base having a detent portion and a locating portion that provides a first position, a platform moveably coupled to the base, and a punch supported by the platform and configured to move between a reset position and a depressed position. The platform includes a detent element configured to engage the detent portion when the platform is proximate the first position and a locating element configured to provide fine location of the platform in the first position relative to the base by engaging the locating portion. The punch forms a pattern in a sheet of material when the punch moves from the reset position to the depressed position and a sheet of material is present proximate the depressed position.

20 Claims, 12 Drawing Sheets

(51) Int. Cl.

| | |
|---|---|
| ***B41K 3/02*** | (2006.01) |
| ***B41K 3/36*** | (2006.01) |
| ***B44B 5/00*** | (2006.01) |
| *B26D 7/26* | (2006.01) |
| *B26D 7/00* | (2006.01) |

(56) References Cited

U.S. PATENT DOCUMENTS

| | | | | |
|---|---|---|---|---|
| 5,025,691 | A | 6/1991 | Deni | |
| D373,385 | S | 9/1996 | Birkholz | |
| 5,601,006 | A | 2/1997 | Quinn et al. | |
| 5,660,105 | A | 8/1997 | Benson et al. | |
| D393,657 | S | 4/1998 | Bennett | |
| D407,752 | S | 4/1999 | Kim et al. | |
| D419,178 | S | 1/2000 | Kim et al. | |
| 6,209,434 | B1 | 4/2001 | Kim et al. | |
| 6,626,965 | B2 | 9/2003 | Workman et al. | |
| 6,739,244 | B1 | 5/2004 | Carbaugh | |
| D508,701 | S | 8/2005 | Corcoran et al. | |
| 7,011,009 | B1 | 3/2006 | Tomich | |
| D540,374 | S | 4/2007 | Corcoran | |
| D542,310 | S | 5/2007 | Corcoran et al. | |
| D587,287 | S | 2/2009 | Corcoran et al. | |
| D607,910 | S | 1/2010 | Corcoran et al. | |
| D632,317 | S | 2/2011 | Corcoran et al. | |
| D656,165 | S | 3/2012 | Block et al. | |
| 2002/0083815 | A1 | 7/2002 | Whiteman et al. | |
| 2003/0037657 | A1 | 2/2003 | Oh et al. | |
| 2003/0164434 | A1* | 9/2003 | Frohnhaus et al. | 248/430 |
| 2003/0205122 | A1 | 11/2003 | Oh | |
| 2005/0253324 | A1 | 11/2005 | Corcoran et al. | |
| 2006/0037503 | A1 | 2/2006 | Winston | |
| 2009/0158909 | A1* | 6/2009 | Loibl | 83/687 |
| 2011/0252939 | A1 | 10/2011 | Nabity et al. | |

OTHER PUBLICATIONS

U.S. Appl. No. 13/192,265, filed Jul. 27, 2011, Andrew P. Block.
Fiskars School Office Craft Products 2005 catalog, pp. 71-73.
Fiskars Craft Products 2007 catalog, pp. 42-57 and 70-83.
European Search Report for European Patent Application No. 12007902.5 Issued Apr. 12, 2013, 5 pages.

* cited by examiner

SECTION A-A

SECTION A-A

SECTION A-A

SECTION B-B

SECTION C-C

SECTION C-C

SECTION D-D

DEVICE FOR FORMING A PATTERN IN A SHEET MATERIAL

BACKGROUND

The present invention relates generally to the field of devices for forming patterns in a sheet of material. The present disclosure relates more specifically to devices for forming a pattern in a sheet of material in a predetermined shape along a straight line or predetermined path at one or more regular intervals as determined by the device.

In scrapbooking and paper craft arts, hobbyists form patterns along the border of sheet materials, such as craft paper, mat for picture framing, etc. Currently, a hobbyist often uses scissors to cut or a die to punch various border patterns. Forming the pattern along the border of the sheet material typically involves repeating the cutting or punching process at regular intervals to form a repeating pattern. Conventional systems and methods require the hobbyist to realign the die and the sheet material for each punching process, which can result in misalignment with the previously formed pattern due to human error.

SUMMARY

One embodiment relates to a device for forming a pattern in a sheet of material. The device includes a base having a detent portion and a locating portion that provides a first position, a platform moveably coupled to the base, and a punch supported by the platform and configured to move between a reset position and a depressed position. The platform includes a detent element configured to engage the detent portion when the platform is proximate the first position and a locating element configured to provide fine location of the platform in the first position relative to the base by engaging the locating portion. The punch forms a pattern in a sheet of material when the punch moves from the reset position to the depressed position and a sheet of material is present proximate the depressed position.

Another embodiment relates to a device for forming a pattern in a sheet of material. The device includes a base, a platform coupled to the base, and an actuator. The base includes a first locating portion, the first locating portion providing a first position, and a second locating portion, the second locating portion providing a second position. The platform is moveable between the first position and the second position and includes a locating element configured to engage the first locating portion when the platform is in the first position and to engage the second locating portion when the platform is in the second position, respectively. The actuator includes a first portion and a second portion, the first portion of the actuator configured move a punch supported by the platform into contact with a sheet of material when the actuator is actuated, and the second portion configured to cause the locating element to engage the locating portion when the actuator is actuated. When the platform is proximate the first position, the locating element provides fine location of the platform in the first position relative to the base by engaging the first locating portion, and when the platform is proximate the second position, the locating element provides fine location of the platform in the second position relative to the base by engaging the second locating portion.

Another embodiment relates to a device for forming a pattern in a sheet of material. The device includes a base and a platform coupled to the base. The base includes a first plurality of detent portions, the detent portions of the first plurality of spaced apart from each other in a first direction, and a second plurality of detent portions, the detent portions of the second plurality of spaced apart from each other in the first direction. The first plurality of detent portions and the second plurality of detent portions are spaced apart from each other in a second direction, and the base provides a first plurality of positions and a second plurality of positions, the positions of the first plurality spaced apart in the first direction, and the positions of the second plurality spaced apart in the first direction. The platform is moveable among the first plurality of positions and the second plurality of positions, and includes a first detent element configured to engage at least one of the detent portions of the first plurality when the platform is proximate the one of the positions of the first plurality of positions and a second detent element configured to engage at least one of the detent portions of the second plurality when the platform is proximate the one of the positions of the second plurality of positions. When the platform receives a first cassette from a first set of cassettes, the first detent element is allowed to engage the detent portions of the first plurality of detent portions, and the second detent element is prevented from engaging the detent portions of the second plurality of detent portions, and when the platform receives a second cassette from a second set of cassettes, the second detent element is allowed to engage the detent portions of the second plurality of detent portions, and the first detent element is prevented from engaging the detent portions of the first plurality of detent portions.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
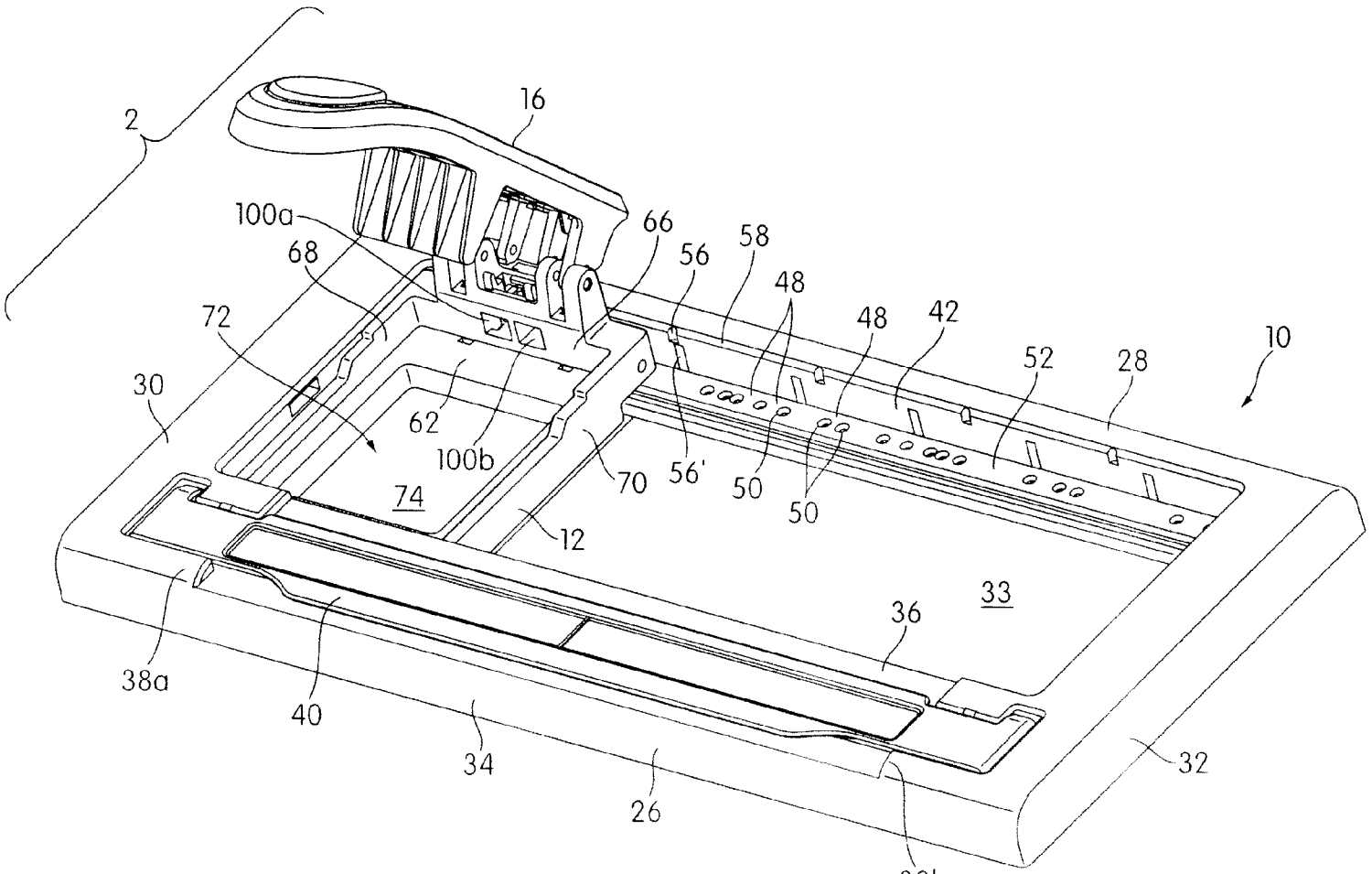
FIG. 1 is a top right perspective view of a device for forming patterns in a sheet of material, shown according to an exemplary embodiment.

Referring generally to the Figures, a device 2 for forming a pattern in a sheet of material and components thereof are shown according to an exemplary embodiment. The device 2 includes a base 10 and a platform 12. The platform 12 is slidably coupled to the base 10, and moveable between a plurality of positions. The platform 12 supports a punch 14, which forms a pattern in the sheet of material when the punch 14 is pressed against or into the sheet of material. An actuator, shown as handle 16, may be rotatably coupled to the platform 12 and is configured to press the punch 14 against the sheet of material.

The base 10 may include at least one detent portion, shown as groove 18, and at least one locating portion, shown as locating hole 20. The platform 12 may include at least one detent element, shown as finger 22, and at least one locating element, shown as pin 24. In operation, a user may form a pattern in the sheet of material with the platform 12 in a first position and then move the platform 12 to a second position to continue the pattern. When the platform 12 is proximate the second position, the finger 22 engages the groove 18, providing a coarse indication of proximity to the second position. The indication may be tactile, audible, or visual. The coarse indication places the platform 12 in the general proximity of the position, and does not necessarily provide a precise location in various embodiments, instead providing a "rough" location of the platform 12. In other words, the engagement of the detent element and the detent portion allows for some "play" between the platform 12 and the base 10.

As the hobbyist actuates the handle 16, the pin 24 enters the locating hole 20, providing fine location of the platform in the second position. The fine location provides a relatively precise location of the platform 12 (in comparison to the course location) relative to the base 10. The tolerance between the pin 24 and locating hole 50 are sufficiently tight that the "play" between the platform 12 and the base 10 is substantially reduced. In other words, the coarse indication places the platform 12 close enough to the desired position, without concern for exact position, such the locating element can engage the locating portion to bring the platform 12 into the position within acceptable tolerances. Accordingly, the punch 14 and sheet of material are aligned such that actuation of the punch 14 in the second position may form a pattern continuous (e.g., not overlapping, not spaced apart from, properly aligned with, etc.) with the pattern formed when the platform 12 was in the first position.

According to various embodiments, the punch 14 may be configured to cut, emboss (raise in relief), deboss (indent into a surface), print, etc., or any combination thereof, into or onto the sheet of material to form various patterns. According to one embodiment, the punch 14 includes a blade configured to cut the sheet of material. According to another embodiment, the punch 14 includes an ink bearing surface (e.g., a stamp) configured to transfer pigment to the sheet of material. According to another embodiment, the punch 14 may include a die configured to form a raised or indented pattern in the sheet of material. According to another embodiment, the punch 14 is configured to form a border pattern (e.g., a pattern along the edge) in the sheet of material.

Figure 2:
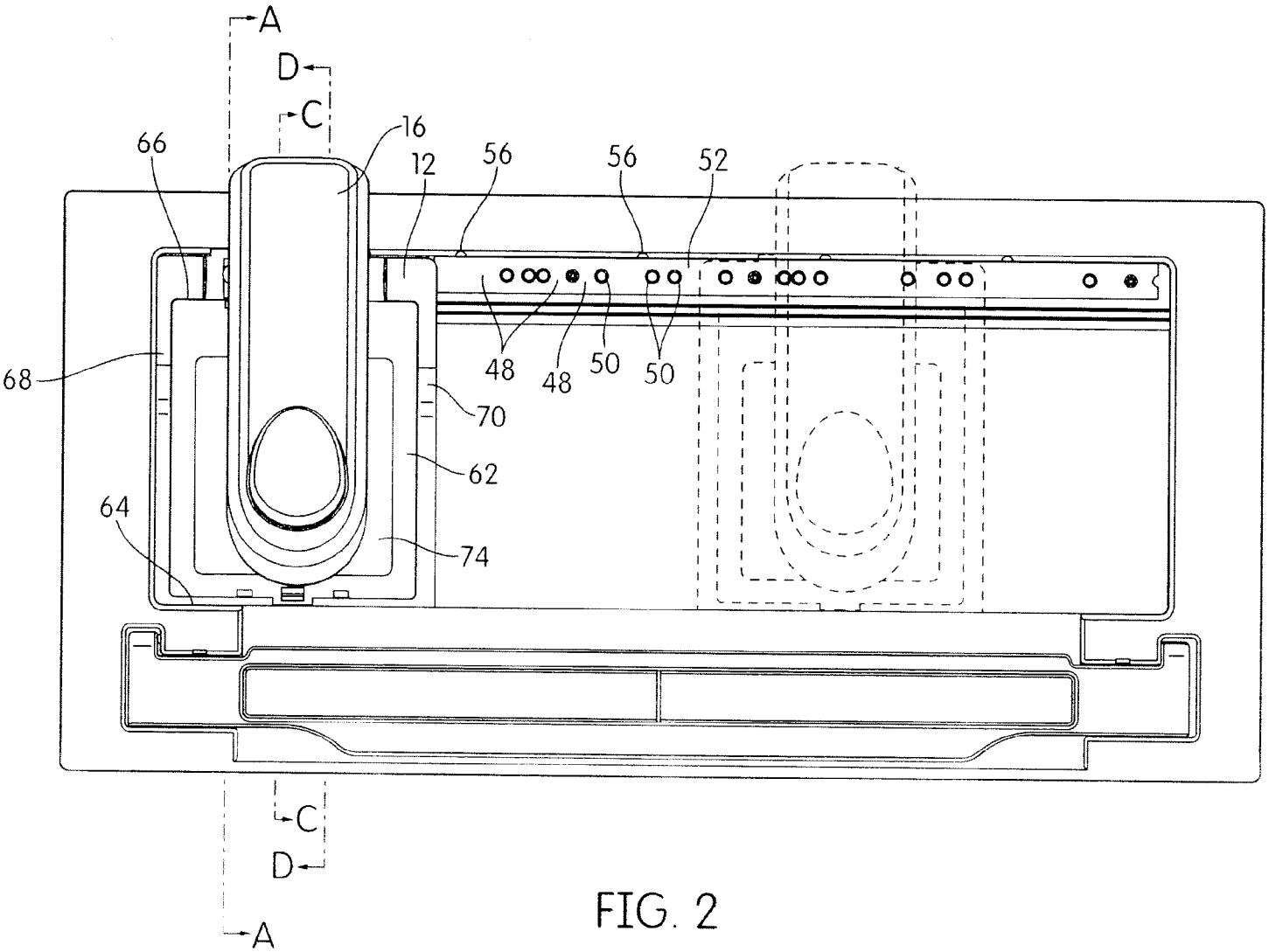
FIG. 2 is a top plan view of the device of FIG. 1, shown according to an exemplary embodiment.
Figure 3:
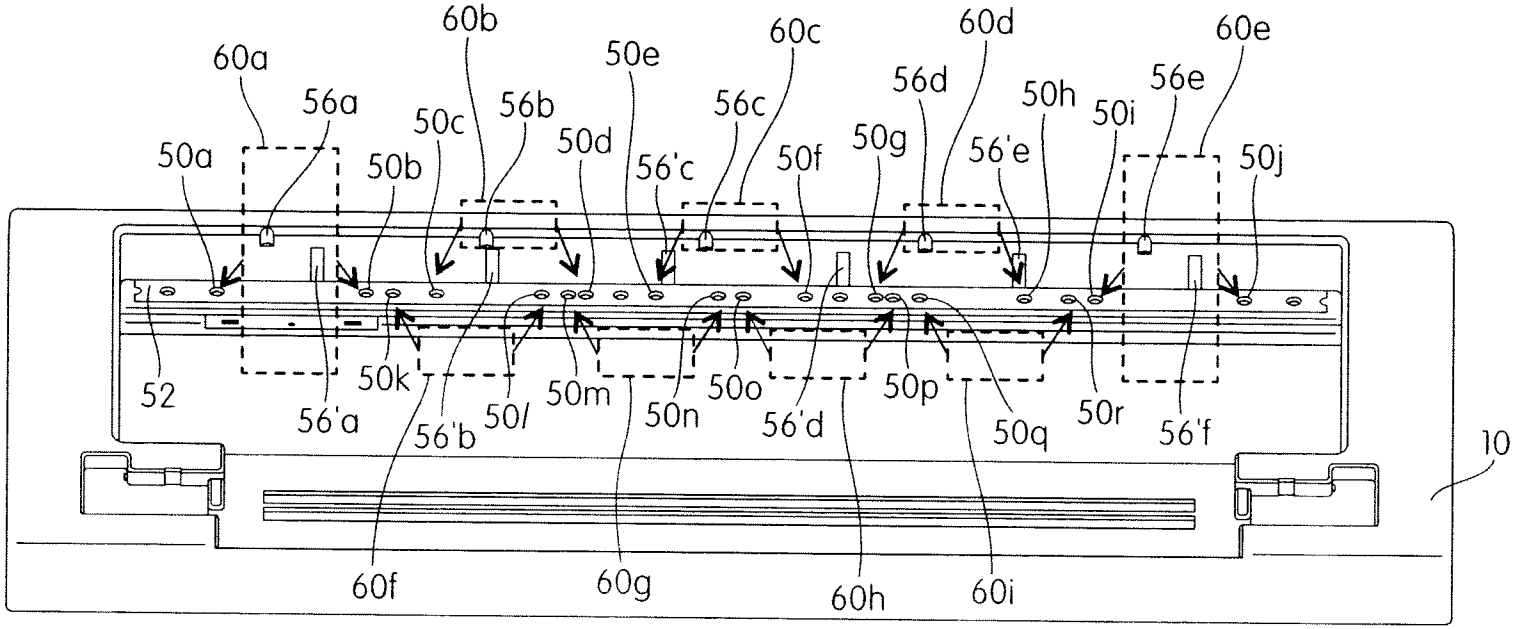
FIG. 3 is a top front perspective view of the base of the device of FIG. 1, shown according to an exemplary embodiment.

Referring to FIGS. 1-3, the device 2 for forming a pattern in a sheet of material is shown, according to an exemplary embodiment. The device 2 includes the platform 12 moveably supported by a base 10. The base 10 includes a first rail, shown as front rail 26, and a second rail, shown as rear rail 28. The front and rear rails 26, 28 extend laterally between a third rail, shown as left rail 30, and a fourth rail, shown as right rail 32. As shown, the first through fourth rails 26, 28, 30 and 32 form a generally rectangular shape defining a hole or recess 33 configured to receive the platform 12. According to other embodiments, the first through fourth rails 26, 28, 30 and 32 may form a trapezoid or a parallelogram, with the front and rear rails 26 and 28 in parallel with each other.

The front rail 26 is shown to include a laterally extending first wall, shown as vertical wall 34, and a laterally extending second wall, shown as horizontal wall 36. The horizontal wall 36 extends rearward from the top of the vertical wall 34 and over at least a portion of the platform 12 when the platform is in an installed position. The horizontal wall 36 is configured to help guide the platform 12 as it slides relative to the base 10. For example, the horizontal wall 36 may prevent the platform 12 from rotating up out of the base 10. Further, the horizontal wall 36 helps to direct forces applied to the platform 12 into lateral motions.

The front rail 26 is further shown to include one or more structures 38, shown as left structure **38*a* and right structure 38*b*, which are configured to align a sheet of material relative to the base 10. The structures 38 further inhibit movement of the sheet during movement of the platform 12 relative to the base 10. According to one embodiment, the structures 38, or a component 40 coupled to the structures 38, may be configured to secure (e.g., fix, retain, clamp, etc.) the sheet of material relative to the base 10, for example, by pressing the sheet against the horizontal wall 36** to increase frictional forces.

The rear rail 28 is shown to include a laterally extending first wall, shown as vertical wall 42, and a laterally extending second wall, shown as horizontal wall 44. The vertical wall 42 extends upward from the horizontal wall 44, which extends under at least a portion of the platform 12 when the platform 12 is in an installed position, and may thereby at least partially support the platform 12. A surface of the horizontal wall 44 is sufficiently smooth to allow the platform 12 to slide thereupon. The distance from the vertical wall 34 of the front rail 26 to the vertical wall 42 of the rear rail 28 is similar to the corresponding fore-aft dimension of the platform 12. The difference in fore-aft dimensions provides sufficient gap to allow a sliding motion of the platform 12 relative to the base 10 while inhibiting rotation of the platform 12 relative to the base 10, which may cause binding and hinder the sliding motion.

The base 10 includes at least one locating portion 48. The locating portions 48 provide laterally spaced discrete positions relative to the base 10. Referring briefly to FIG. 3, the locating portions 48 may define locating holes **50*a*-50*r* (generally referred to as locating holes 50). Locating holes 50 are configured to receive a pin 24 from the platform 12 (see, e.g., FIGS. 6-8) with sufficiently tight tolerances to provide fine location of the platform 12 relative to the base 10. In the embodiment shown, the tolerances between the pin 24 and the locating hole 50** provide for a sliding fit. In a particular embodiment, the coarse alignment may have a tolerance of about +/−0.5 mm, while the fine alignment may have a tolerance of about +/−0.2 mm. However, other tolerances are possible in various embodiments.

Figure 6:
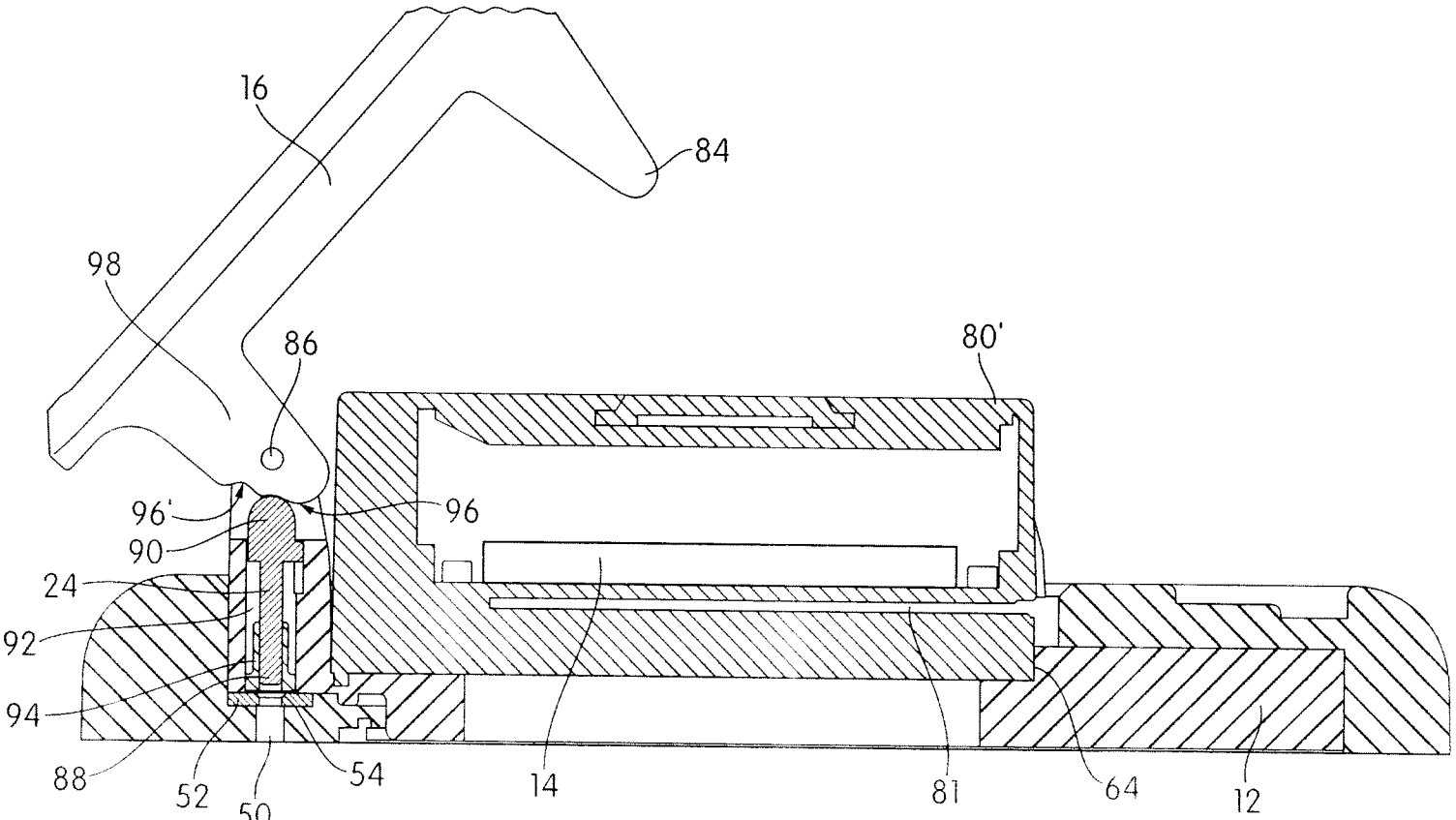
FIG. 6 is a sectional view of a portion of the device of FIG. 1, through lines A-A of FIG. 2, shown according to an exemplary embodiment when the device is in a first position.
Figure 7:
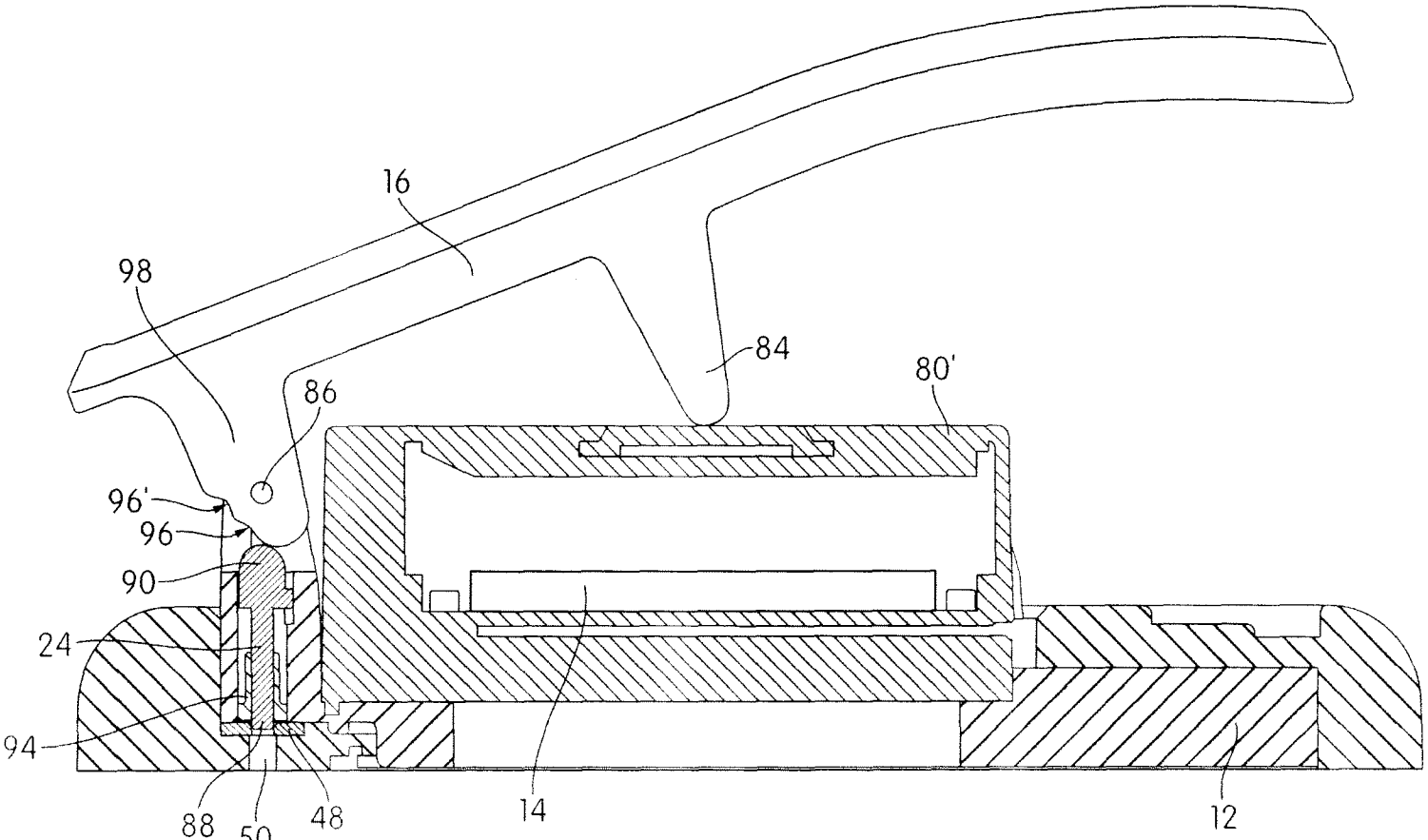
FIG. 7 is a sectional view of a portion of the device of FIG. 1, through lines A-A of FIG. 2, shown according to an exemplary embodiment when the device is in a second position.
Figure 8:
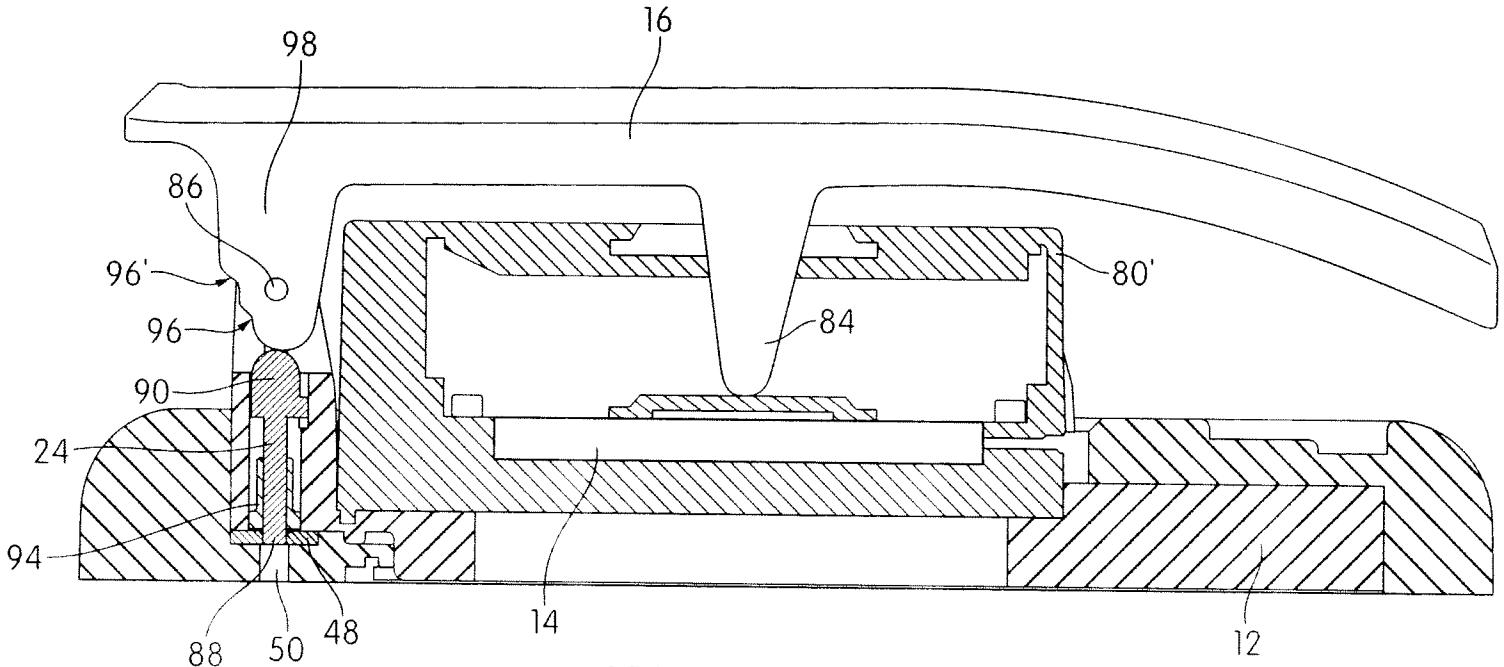
FIG. 8 is a sectional view of a portion of the device of FIG. 1, through lines A-A of FIG. 2, shown according to an exemplary embodiment when the device is in a third position.

According to the embodiment shown, the locating holes 50 are formed in an insert 52 coupled to the horizontal wall 44 of the rear rail 28 and may extend further into the horizontal wall 44. The insert 52 is formed of a durable material (e.g., metal, steel, etc.). Using an insert 52 formed of a durable material resists wear, thereby maintaining the location and tolerances of the holes 50 and maintaining the ability of the locating holes 50 to finely locate the platform 12 relative to the base 10. Referring briefly to FIGS. 6-8, the lip 54 around the locating hole 50 is contoured (e.g., rounder, chamfered, etc.) to help guide the pin 24 into the locating hole 50. According to other embodiments, the locating portions 48 may be located in another region of the base 10 (e.g., the vertical wall 42 of the rear rail 28, the front rail 26, etc.).

Referring to FIG. 3, the locating holes 50 may be organized into a first plurality of locating holes 50, including locating holes 50*a*-50*j*, and a second plurality of locating holes 50, including locating holes 50*k*-50*r*. The locating holes 50 of the first and second pluralities of locating holes 50 are shown to be interspaced. The locating holes 50 may further by organized into pairs of holes (e.g., 50*a*-50*b*, 50*c*-50*d*, 50*e*-50*f*, 50*k*-50*l*, etc.). According to one embodiment, each locating portion 48 defines a pair of holes 50 configured to receive a pair of pins 24*a*, 24*b* (see, FIG. 9) from the platform 12. By using two pins 24, both linear and rotational alignment between the platform 12 and the base 10 may be maintained within the locating element to locating portion tolerances, thus providing more accurate location of the platform 12 relative to the base 10.

The base 10 includes at least one detent portion, shown as grooves. The grooves are configured to receive a finger 22 from the platform 12, and thereby to temporarily keep the platform 12 in a certain position relative to the base 10, and to release the platform 12 from the certain position upon the application of force to the platform 12.

Referring to FIG. 3, the grooves may be organized in a first plurality of grooves 56, including grooves 56*a*-56*e*, and a second plurality of grooves 56', including grooves 56'*a*-56'*f*. The first plurality of grooves 56 are spaced apart from each other in a first direction (e.g., laterally) and the second plurality of grooves 56' are spaced apart in a first direction (e.g., laterally). The first plurality of grooves 56 and the second plurality of grooves 56' are shown spaced apart from each other in a second direction (e.g., vertically). The first and second pluralities of grooves 56 and 56' are shown spaced vertically apart along the vertical wall 42 of the rear rail 28. According to other embodiments, the second plurality of grooves 56' may be spaced along the vertical wall 42, and the first plurality of grooves 56 may be located on another surface, for example, the top surface 58 of the rear rail 28. As shown, the first plurality of grooves 56 extend through the top surface 58 of the rear rail 28. It is further contemplated that one or both pluralities of grooves 56 and 56' may be spaced along the front rail 26.

Referring to FIG. 3, the locating portions 48 (e.g., the locating holes 50 theredefined) provide a plurality of discrete positions 60 relative to the base 10. As shown, the locating holes 50 of the first plurality of locating holes 50 define a first set of positions 60, shown as a first through fifth discrete positions 60*a*-60*e*. Each position 60 of the first set of positions corresponds to one of the grooves of the first plurality of grooves 56. The locating holes 50 of the second plurality of locating holes 50 are shown to define a second set of positions 60, shown as a first through sixth discrete positions 60*a*, 60*f*-60*i*, 60*e*. Each position 60 of the second set of positions corresponds to one of the grooves of the second plurality of grooves 56'. According to the exemplary embodiment shown, the end positions 60*a*, 60*e* of each set of positions are in the same location. That is, the first position 60*a* of the first set of positions and the first position 60*a* of the second set of positions use the same locating holes 50*a*, 50*b*, and accordingly are in the same location. Similarly, the fifth position 60*e* of the first set of positions and the sixth position 60*e* of the second set of positions use the same locating holes 50*i*, 50*j*, and thus are in the same location. The intermediate positions 60*b*-60*d*, 60*f*-60*i* of each set of positions are evenly spaced between the end positions 60*a*, 60*e*. Referring to FIG. 2, the platform 12 shown in solid lines is in position 60*a*, and the platform shown in dashed lines is in position 60*d*.

The positions 60 and the locating holes 50 are spaced such that when the platform 12 is moved to an adjacent position 60, the pattern formed in the sheet of material in that position 60 is continuous with the pattern formed in the sheet of material when the platform 12 was in the previous position 60. For example, the first plurality of positions 60 may be used with a first punch 14 (e.g., used with a first cassette 80') configured to form a first pattern in the sheet material and having a first dimension in the first direction (e.g., lateral). The second plurality of positions 60 may be used with a second punch 14 (e.g., used with a second cassette 80") configured to form a second pattern in the sheet material and having a second dimension in the first direction (e.g., lateral). According to the exemplary embodiment shown, the lateral dimension of the second punch 14 is less than the lateral dimension of the first punch 14. Accordingly, there are more positions in the second plurality of positions 60 between the end positions 60*a*, 60*e*.

Figure 4:
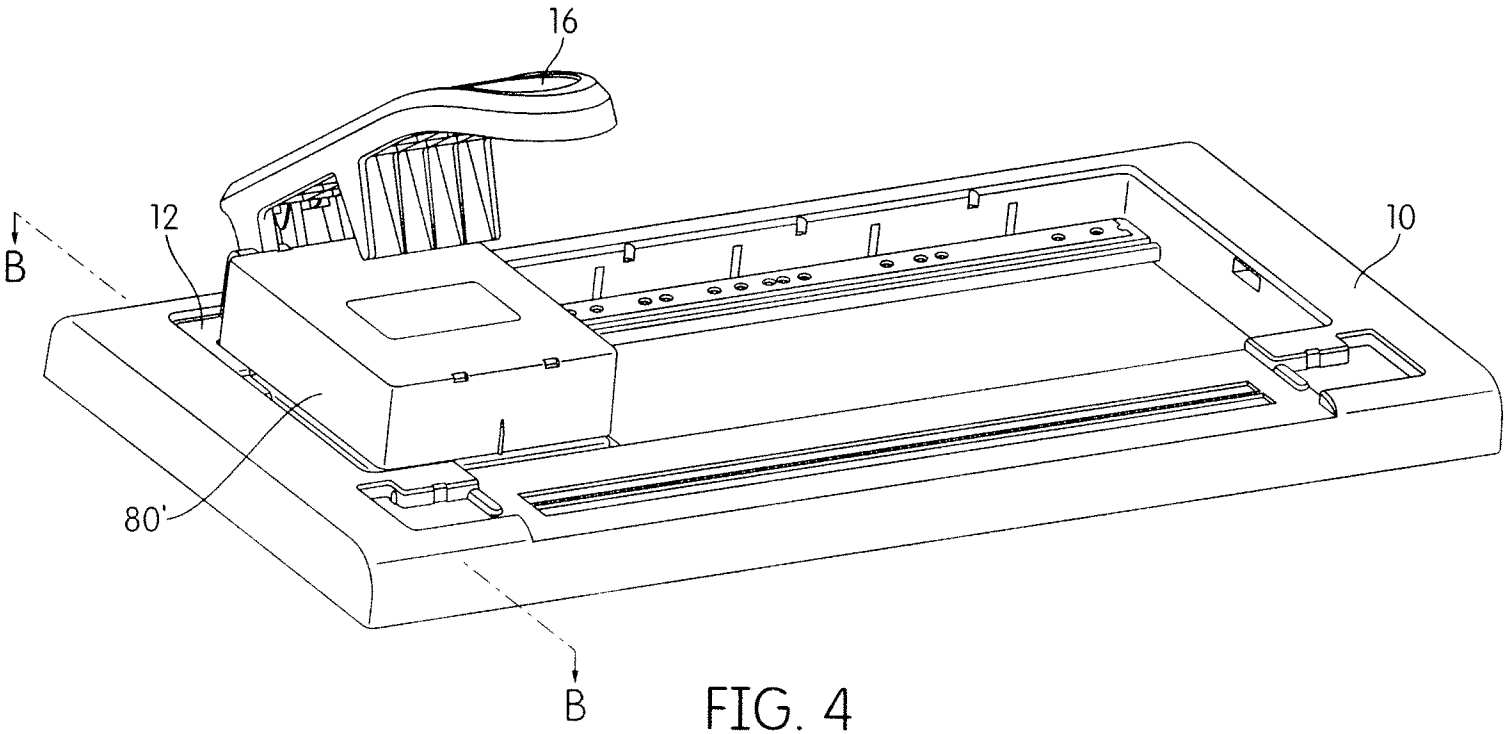
FIG. 4 is a top left perspective view of the device of FIG. 1, shown according to an exemplary embodiment.
Figure 5:
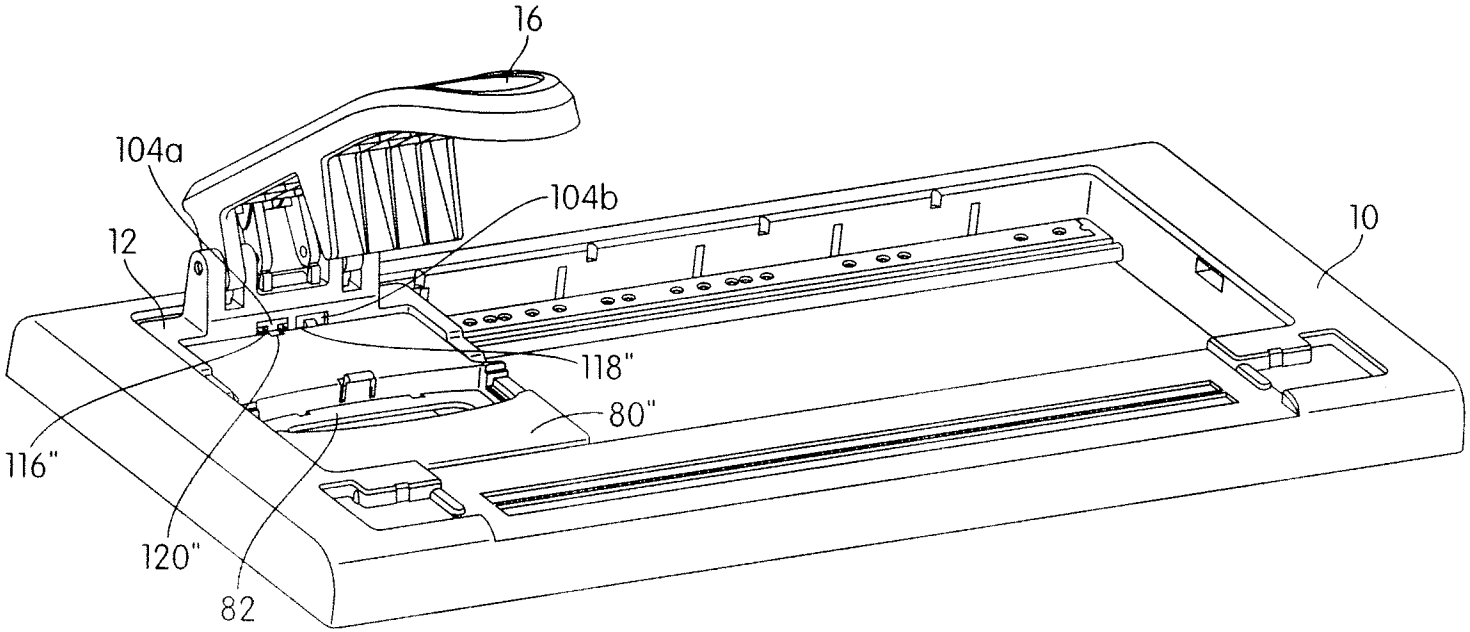
FIG. 5 is a top left perspective view of the device of FIG. 1, shown according to an exemplary embodiment.

Referring to FIGS. 1-2, a platform 12 is shown according to an exemplary embodiment. The platform 12 includes a bottom wall 62 and a plurality of sidewalls extending upward from the bottom wall 62, shown as first or front wall 64 (see, FIG. 6), a second or rear wall 66, and a third and a fourth sidewall 68, 70 extending between the front and rear walls 64, 66. The rear wall 66 is shown to include at least one opening 100, shown as first opening 100*a* and second opening 100*b*, extending rearward through the rear wall 66 from the cavity 72 towards the rear rail 28 of the base 10. The bottom wall 62 and sidewalls define a cavity 72 configured to receive a cassette (e.g., a first cassette 80' as shown in FIG. 4, a second cassette 80" as shown in FIG. 5, a cartridge, etc.) that is configured to receive a punch 14 therein. The bottom wall 62 defines an opening 74 passing therethrough. The opening 74 allows any material severed from the sheet of material to pass therethrough, thus preventing accumulation of material in the cassette 80 (in general reference to the first cassette 80' or the second cassette 80") or proximate the punch 14 which may affect operation of the punch.

Referring to FIGS. 4-8, the platform 12 may directly or indirectly support a punch 14. As shown in FIGS. 4 and 6-8, the punch 14 may be supported by a cassette 80. The cassette may include a slot 81 proximate the punch 14 and configured to receive the sheet of material therein. The cassette 80 may protect blades or ink in the punch 14 from debris, damage, or incidental contact with the user. The cassette 80 may further allow variously shaped and sized punches 14 to be used with the platform 12 while providing a uniform interface between the cassette 80 and the platform 12. Referring briefly to FIG. 5, the cassette 80" may include a receptacle 82 configured to receive a punch 14. According to one embodiment, the receptacle 82 may receive a smaller cassette having a punch 14 therein. Accordingly, the cassette 80" may be an adapter plate to which a cassette of different shape or size may couple.

Referring to FIGS. 6-8, the punch 14 is configured to move between a first position, shown as a reset position in FIG. 6, and a second position, shown as a depressed position in FIG. 8. The punch 14 forms a pattern in the sheet of material when the punch 14 moves from the reset position to the depressed position and a sheet of material is present proximate the depressed position. In an embodiment in which the punch 14 transfers ink to the material, the sheet of material will remain below the punch 14 when the punch 14 is in the depressed position. In an embodiment in which the punch 14 cuts a pattern in the sheet of material, a portion of the punch 14 (e.g., a blade) may pass through the sheet of material to the depressed position. According to one embodiment, the blade, die, or inking element of the punch 14 may be located below the sheet of material, in which case depressing the punch 14 pushes the sheet of material into the blade, die, or inking material to form a pattern in the sheet of material.

The device 2 may further include an actuator, shown as handle 16, having a first portion 84 configured to press the punch 14 against the sheet of material. According to the embodiment shown, the handle 16 is rotatably coupled to the platform 12 about an axis 86. As such, the handle 16 behaves as a lever, wherein the fulcrum is the axis 86. The handle moves between a first position, shown as an up position in FIG. 6, and a third position, shown as a punching position in FIG. 8. With respect to FIGS. 6-8, moving from the first to third position is a clockwise rotation. The handle 16 may also rotate counterclockwise with respect to FIGS. 6-8 to a fourth position (not shown) which provides greater clearance to install or remove a cassette 80 from the platform 12. According to another embodiment, the handle 16 may by coupled to the base 10. For example, the handle 16 may extend laterally such that the handle 16 may actuate the punch 14 regardless of the position of the platform 12.

Figure 9:
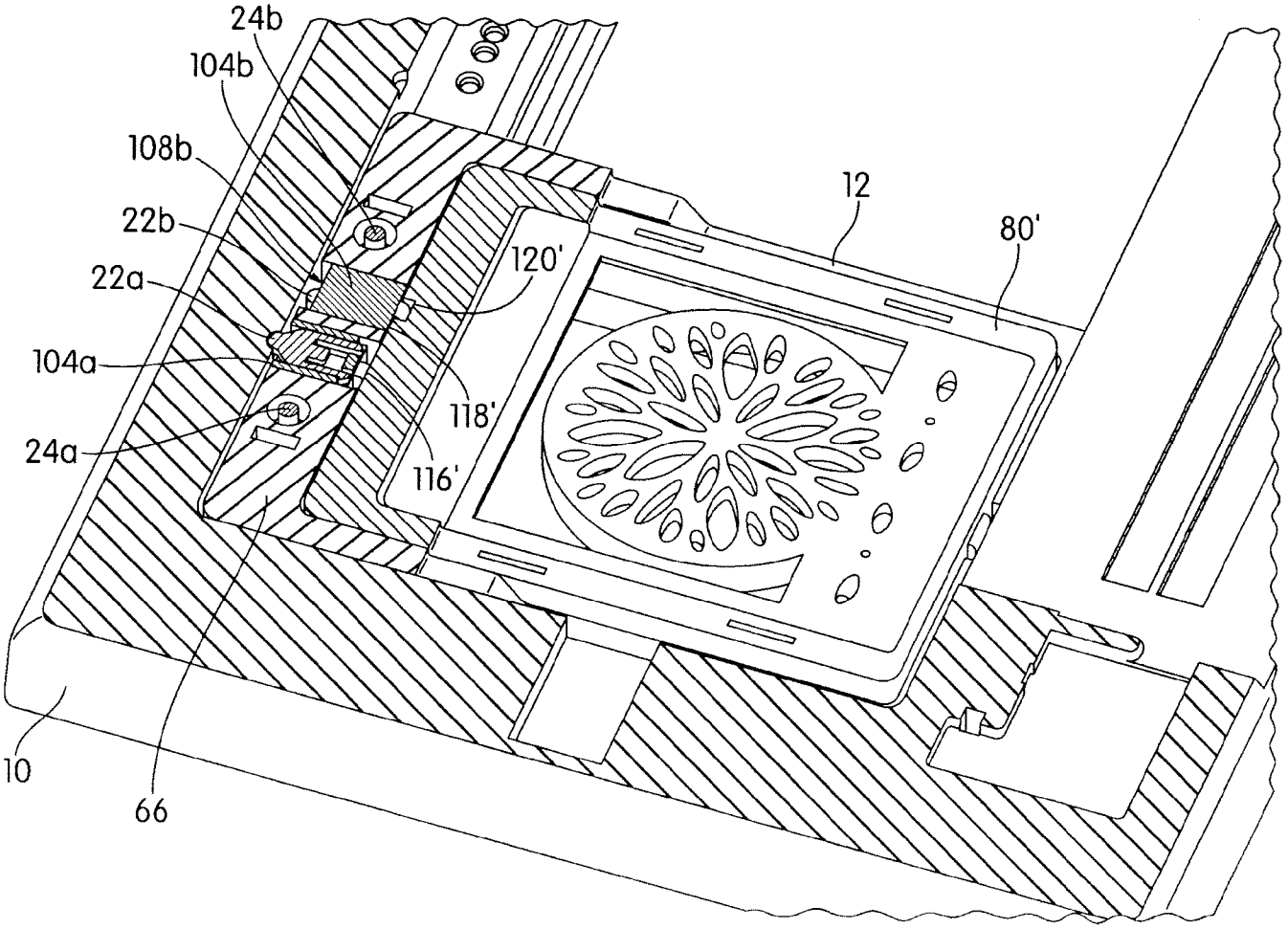
FIG. 9 is a sectional view of a portion of the device of FIG. 4 through lines B-B, shown according to an exemplary embodiment.

As shown in FIGS. 6-9, the device 2 may include at least one pin 24 configured to provide fine location of the platform 12, and thus the punch 14, relative to the base 10, and thus the sheet of material, by engaging the at least one locating hole 50 of the base 10. As shown in FIG. 9, the locating element preferably includes a first pin 24*a* and a second pin 24*b* laterally spaced a first distance from the first pin 24*a*. The corresponding first and second locating holes 50 of the locating portion are also laterally spaced the first distance from each other.

The pin 24 has a first end 88 and a second end 90 disposed opposite the first end. The pin 24 is slidably disposed in a bore 92 in the platform 12 and moveable between a first, shown as a retracted state in FIG. 6, and a second state, shown as an extended state in FIG. 8. When the pin 24 is in the retracted state, the first end 88 of the pin is retracted into the platform 12. In the retracted state, the pin 24 does not inhibit the platform 12 from sliding between positions 60. In the extended state, the first end 88 of the pin 24 extends from the platform 12 into a locating hole 50 of the locating portion 48. A resilient return member 94 (e.g., spring, coned-disc spring, a layer of resilient material, a resilient formation of the pin 24, etc.) coupled between the platform 12 and the pin 24 applies a return force on the pin 24 such that the pin 24 normally returns to the retracted state.

The second end 90 of the pin 24 is shown to be a cam follower configured to follow a cam profile 96 (e.g., cam surface) located on a second portion 98 of the handle 16. As shown, the cam profile 96 is located at least partially around the axis 86. According to another embodiment, the cam surface may be located on another portion of the handle 16 (e.g., a member extending from the handle 16). The cam profile 96 is configured such that when the handle 16 is in the first position, the platform 12 may be slid along the base 10. As the handle 16 moves to a second position (see, e.g., FIG. 7) between the first and third position, the cam profile 96 pushes the pin 24 down into the locating hole 50, thus providing fine alignment of the platform 12 to the base 10. In the second position, the pin 24 has engaged the locating hole 50, but the first portion 84 of the handle 16 has not yet pushed the punch 14 into contact with the sheet of material. As the handle 16 moves to the third position, the pin 24 is fully engaged in the locating hole 50, and the punch 14 is pressed into the sheet of material to form the pattern. As the handle 16 is returned to the first position, the return member 94 forces the pin 24 back to the retracted state.

Because the detent has coarsely aligned the platform 12 proximate one of the positions 60 (discussed in more detail below), the first end 88 of the pin 24 at least contacts the lip 54 of the locating hole 50, and is thus guided into the locating hole 50. As such, the user does not need to carefully align the pin 24 with the locating hole 50. Accordingly, engagement of the pin 24 to the locating hole 50 occurs automatically during the punching process. Even though the user did not carefully align the platform 12 to the base 10, the engagement of the locating pin 24 to the locating hole 50 finely aligns the platform 12 to the base 10 within the tolerances of the pin 24 to the locating hole 50. According to one embodiment, the pin 24, locating hole 50, and lip 54 are configured that the engagement of the pin 24 to the locating hole 50 is silent (e.g., less than approximately 30 dB). According to another embodiment, the sound from the pin 24 engaging the locating hole 50 is less than (e.g., drown out by) the sound generated by moving the handle 16, moving the punch 14, or forming the pattern in the sheet of material.

The cam profile 96 is shown to include a second cam profile 96'. The second cam profile 96' is configured such that when the handle 16 is raised from the first position to a fourth position, the return force from the return member 94 acting on the pin 24, holds the handle 16 in the fourth position. In the fourth position, the handle 16 is moved clear of the cassette 80 to facilitate installation and removal of the cassette 80 from the platform 12.

Referring to FIGS. 1 and 9-12, interaction of the detent element and the detent portion is shown according to an exemplary embodiment. The detent element, shown as first detent element 102*a* and second detent element 102*b*, may include a springbox (e.g., first springbox 104*a*, second springbox 104*b*), generally referred to herein as springbox 104 and slidably disposed within one of the first and second openings 100*a*, 100*b* in the rear wall 66 of the platform 12. For the purposes of this disclosure, the components of the first detent element 102*a* are subscripted "a", the components of the second detent element 102*b* are subscripted "b", and the components of the first and second detent elements 102*a*, 102*b* are generally referred to herein without (a) and (b) designations. The springbox 104 includes a front surface 106 and a rear surface 108. A nub 110 (e.g., structure, protuberance, etc.) extends forward from the front surface 106 of the springbox 104. The fore-aft distance from the forward tip of the nub 110 to the rear surface 108 of the springbox 104 is less that the fore-aft thickness of the rear wall 66 of the platform 12. Accordingly, the springbox 104 may be placed within the rear wall 66. The detent element 102 is shown and described on the rear wall 66 of the platform 12, but in other embodiments may be located on other regions of the platform 12 (e.g., the front wall 64).

The spring box 104 defines a chamber 112 extending into the spring box 104 from the rear surface 108. A finger 22 (e.g., member, rod, etc.) is slidably disposed within the chamber 112. A resilient return member (e.g., a coned-disc spring, a layer of resilient material, a resilient formation of the finger, etc.) shown as spring 114, is disposed within the chamber 112 between the finger 22 and the springbox 104. The spring 114 is configured to exert a separating force on the finger 22 and the springbox 104.

The chamber 112*a* of the first detent element 102*a* is offset in a first direction (e.g., upward) from center, and the chamber 112*b* of the second detent element 102*b* is offset in a second direction (e.g., downward) from center. According to the embodiment shown, the first detent element 102*a* and the second detent element 102*b* are the same element, but rotated about the chamber axis to cause different elevations of the finger 22 when the detent element 102 is installed in its respective opening 100*a*, 100*b* in the platform 12. The finger 22*a* of the first detent element 102*a* is thus aligned with the elevation of the grooves of the first plurality of grooves 56, and the finger 22*b* of the second detent element 102*b* is aligned with the grooves of the second plurality of grooves 56'. In an embodiment with only a single plurality of detent portions, it may not be necessary to selectively engage the first or second detent elements 102*a*, 102*b*. Accordingly, the chamber 112 of the springbox 104 may be formed directly into the rear wall 66 of the platform 12 and the finger 22 disposed therein.

The cassettes 80 may be further configured such that cassettes from a first set of cassettes cause a first detent element to engage detent portions of the first plurality of detent portions while preventing the detent element from engaging detent portions of the second plurality of detent portions, and that cassettes from a second set of cassettes cause a second detent element to engage detent portions of the second plurality of detent portions while preventing the detent element from engaging detent portions of the first plurality of detent portions. Accordingly, depending on which cassette is inserted into the platform, the platform may stop at different positions along the base.

Figure 12:
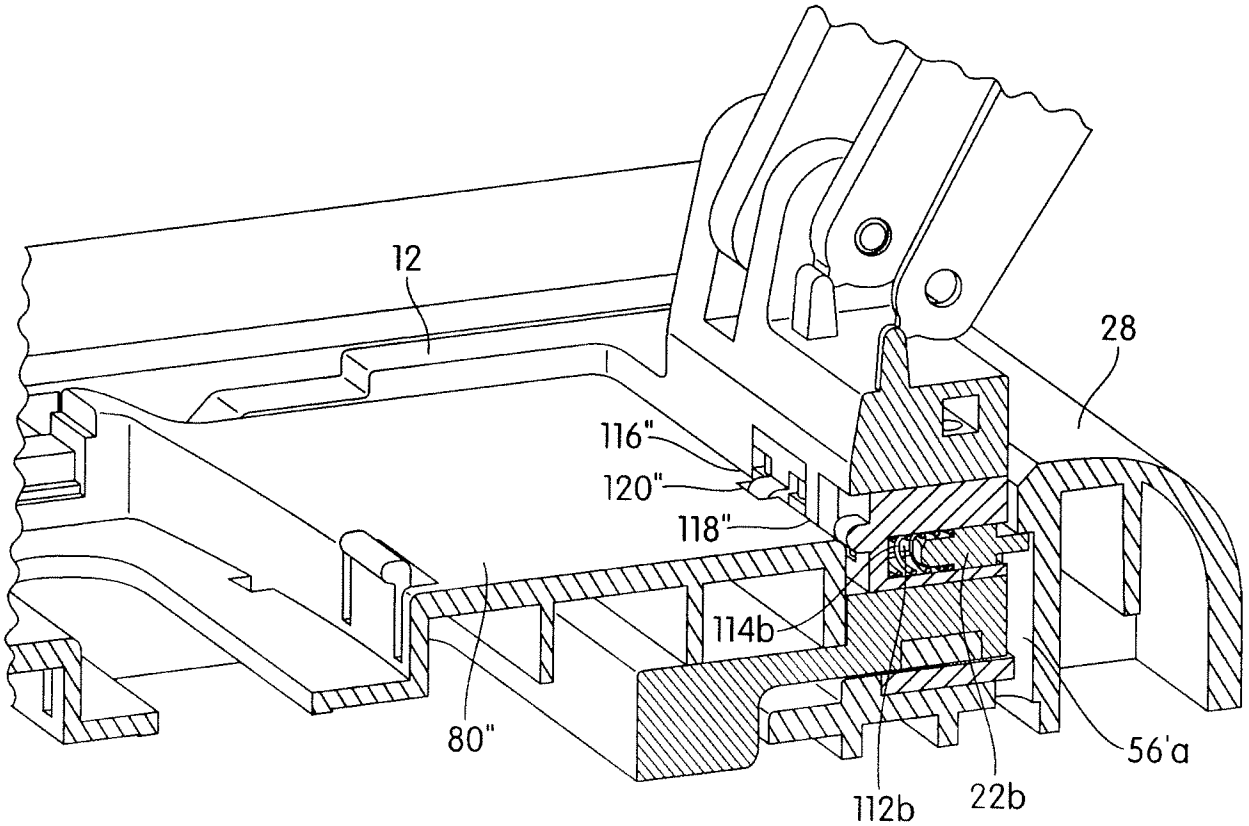
FIG. 12 is a sectional view of a portion of the device of FIG. 1, through lines D-D of FIG. 2, shown according to an exemplary embodiment.

Referring to FIG. 9, when the first cassette 80' is coupled to the platform 12 (e.g., inserted into the cavity 72), the first finger 22*a* is allowed to engage the grooves of the first plurality of grooves 56, and the second finger 22*b* is prevented from engaging the grooves of the second plurality of grooves 56'. Referring briefly to FIG. 12, when the second cassette 80" is coupled to the platform 12, the second finger 22*b* is allowed to engage the grooves of the second plurality of grooves 56' and the first finger 22*a* is prevented from engaging the grooves of the first plurality of grooves 56.

The first cassette 80' is from a first set of cassettes having a first surface 116' and a second surface 118', shown to be portions of the rear surface of the cassette 80'. The second surface 118' is recessed from the first surface 116' and defines a recess 120' (e.g., cavity, opening, receptacle, etc.). When the first cassette 80' is installed in the platform 12, the first surface 116' is proximate the first detent element 102*a*, and the second surface 118' is proximate the second detent element 102*b*. The first surface 116' contacts the nub 110*a* of the first springbox 104*a*, pushing the first springbox 104*a* rearward such that the extension force on the spring 114*a* may push the finger 22*a* against the rear rail 28 of the base 10. Accordingly, when the finger 22*a* is proximate a groove 56 of the first plurality of grooves, the spring force pushes the finger 22*a* into the groove 56, thereby engaging the detent portion. As described above, the grooves 56, 56' of the first and second pluralities of grooves may be vertically staggered such that the first finger 22*a* passes by and does not engage the grooves of the other plurality.

Figure 10:
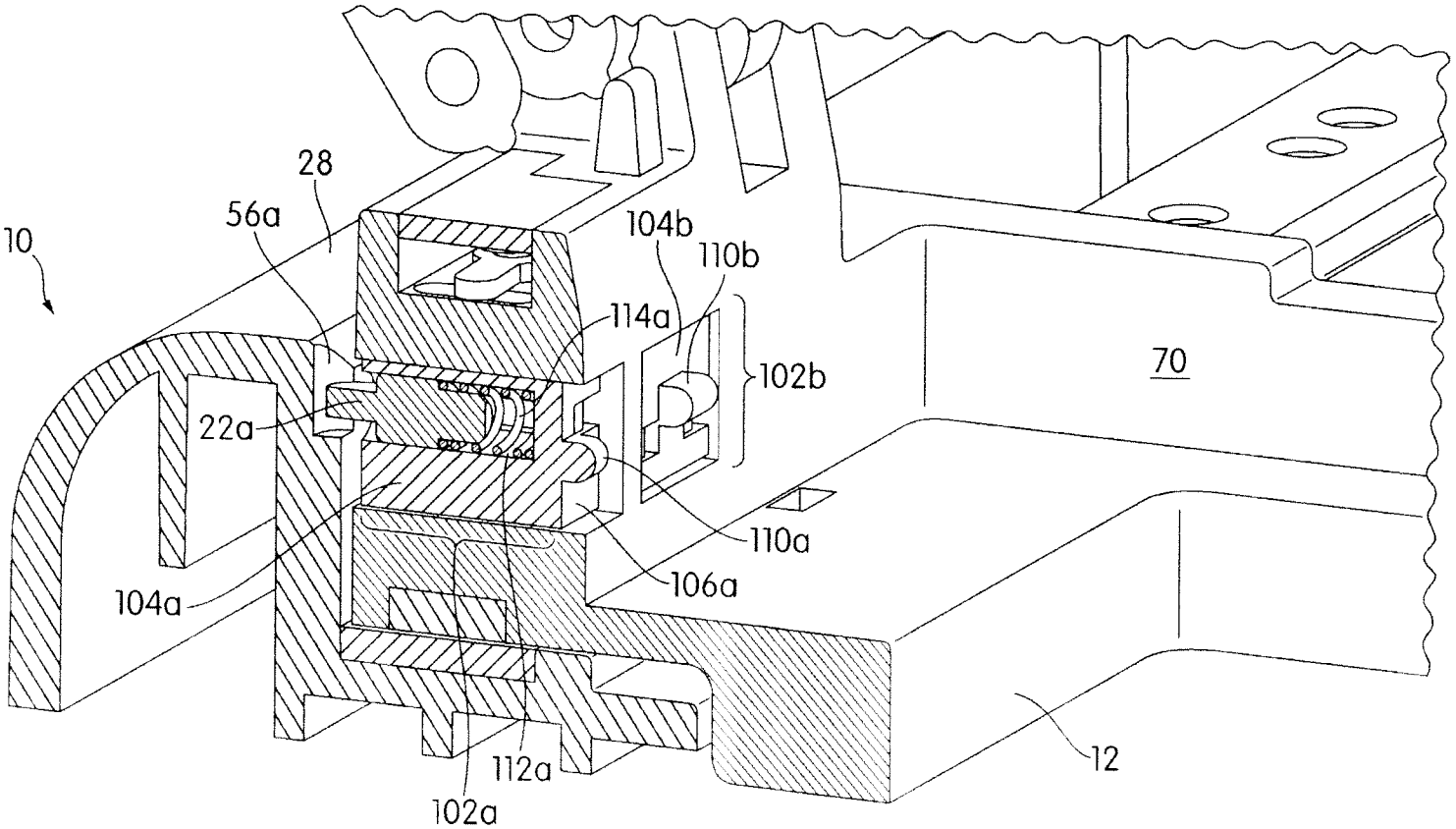
FIG. 10 is a sectional view of a portion of the device of FIG. 1, through lines C-C of FIG. 2, shown according to an exemplary embodiment.
Figure 11:
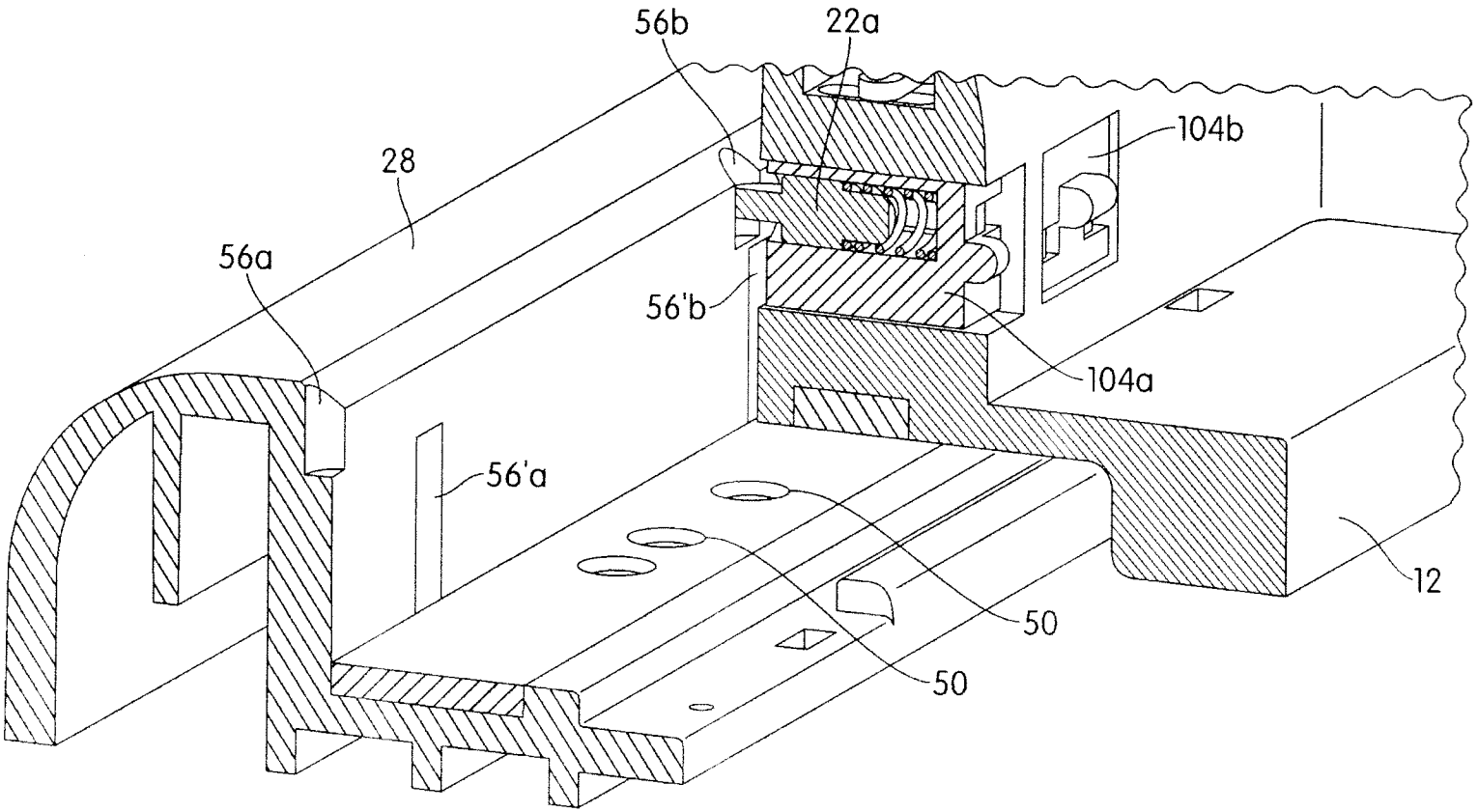
FIG. 11 is a sectional view of a portion of the device of FIG. 1, through lines C-C of FIG. 2, shown according to an exemplary embodiment.

Engagement between the detent element and the detent portion provides a coarse indication of proximity of the platform 12 to the corresponding position 60. The indication may be a tactile or haptic indication. For example, a user may feel the increased resistance to movement caused by the detent or may feel the impact of the finger 22 extending into the groove 56. In an embodiment in which the detent element and the detent portion are magnetic, the user may feel the resistance to movement caused by the coupling of the magnetic fields. The indication may be aural or audible. For example, a user may hear the impact (e.g., "click") of the finger 22 extending in to the groove 56. The indication may be visible. For example, as shown in FIGS. 2, 10, and 11, the groove 56 may extend through the top surface 58 of the rear rail 28. Accordingly, the user may see the finger 22 extending into the groove 56.

The reactionary force resulting from the rear rail 28 of the base 10 acting on the second finger 22*b* causes the spring 114*b* to push at least a portion of the second springbox 104*b* into the recess 120' defined by the second surface 118'. The spring 114*b* is now in a relaxed state, and accordingly, does not push the finger 22*b* into the grooves of the second plurality of grooves 56' when proximate thereto.

Referring to FIGS. 5 and 12, a second cassette 80" from a second set of cassettes is shown according to an exemplary embodiment. The second cassette 80" has a first surface 116" and a second surface 118", shown to be portions of the rear surface of the cassette 80", the first surface 116" recessed from the second surface 118" and defining a recess 120" (e.g., cavity, opening, receptacle, etc.). When the second cassette 80" is installed in the platform 12, the first surface 116" is proximate the first detent element 102*a*, and the second surface 118" is proximate the second detent element 102*b*. The second surface 118" contacts the nub 110*b* of the second springbox 104*b*, pushing the second springbox 104*b* rearward such that the extension force on the spring 114*b* may push the second finger 22*b* against the rear rail 28 of the base 10. Accordingly, when the second finger 22*b* is proximate a groove 56' of the second plurality of grooves, the spring force pushes the second finger 22*b* into the groove 56', thereby engaging the detent portion. Engagement between the finger 22*b* and the groove 56' provides a coarse indication of proximity of the platform 12 to the corresponding position 60.

The contact between the first detent element 102*a* (i.e., the first finger 22*a*) and rear rail 28 forces at least a portion of the first detent element 102*a* (i.e., the springbox 104*a*) into the recess 120" defined by the first surface 116". According to the embodiment shown, the springbox 104*a* is pushed into the recess 120" until the spring 114*a* reaches a relaxed state. Accordingly, the first finger 22*a* does not engage the grooves of the first plurality of grooves 56 when proximate thereto.

The tip of the fingers 22 and the first and second plurality of grooves 56, 56' are shown to be shaped (e.g., rounded, chamfered, etc.) such that resultant forces on the interface between the groove 56, 56' and the finger 22 caused by lateral force on the platform 12 will push the finger 22 into the springbox 104, thus permitting the platform 12 to be moved to another position 60, for example, from the position shown in FIG. 10 to the position shown in FIG. 11.

Operation of the device 2 is described according to an exemplary embodiment. A cassette 80 having a punch 14 therein is received into platform 12. The platform 12 moves proximate a first position 60*a*. A finger 22 engages a groove 56*a* corresponding to the first position 60*a*. The handle 16 moves from the first position to the second position, which automatically causes the a pin 24*a* to move from a retracted state to and extended state and thereby engage a locating hole 50*a*. The handle 16 then continues to move from the second position to the third position, which causes the punch 14 to move from the reset position to the depressed position, which in turn causes a pattern to be formed in the sheet of material.

The handle 16 returns to the first position, and the resilient return member 94 forces the pin 24*a* into the retracted state.

The platform receives lateral force. The resultant forces generated at the interface of the finger 22 and the groove 56 cause the finger to retract in to the platform 12. The platform 12 slides along the base until the platform 12 is proximate the second position 60*b*. The finger 22 engages a groove 56*b* corresponding to the second position 60*b*, thereby providing a coarse indication of proximity to the second position 60*b*. As the handle 16 moves from the first position to the third position, the first end 88 of the pin 24*a* interfaces with the lip 54 of the detent portion 48 and is thereby guided into the locating hole 50*c*. The pin 24*a* provides fine alignment of the platform 12 relative to the base in the second position 60*b* when the pin 24*a* engages the locating hole 50*c*. As the handle 16 moves to the third position, the punch 14 moves from the reset position to the depressed position, which in turn causes a pattern to be formed in the sheet of material. Fine alignment of the platform 12 relative to the base 10 in the first position 60*a* and in the second position 60*b* causes the pattern formed when in the second position 60*b* to be continuous with the pattern formed when in the first position 60*a*.

The handle 16 may then return to the first position, and the platform may move a third position 60*c*. The process may then be repeated to form third, fourth, and so on continuous portions of the pattern formed in the sheet of material. According to one embodiment, the device 2 may be used to form a pattern in a sheet of material in a predetermined shape along a straight line or predetermined path at one or more regular allowed intervals as determined by the device 2.

Other configurations of the components of this disclosure are contemplated. For example, according to one embodiment, the locating portion 48 may be or include a pin, and the locating element may be a hole. For example, the pin may be coupled to the base 10 and configured to engage a hole in the platform 12. According to another embodiment, the detent portion may be a finger, and the detent element may be a groove. For example, the finger may be coupled to the base 10 and configured to engage a groove on the platform 12.

According to one embodiment, the detent portion and the detent element may be or include corresponding magnets (e.g., having opposite polarity). For example, magnetic forces may be used to provide a coarse indication of proximity to a desired position 60. According to another embodiment, the locating portion 48 and the locating element may be or include corresponding magnets (e.g., having opposite polarity). The magnets may be used to provide fine alignment of the platform 12 relative to the base 10. For example, a magnet may be coupled to the end of the pin, and when the handle 16 is actuated, the pin is moved such that the magnetic field at the end of the pin couples to the magnetic field of the corresponding locating portion 48. The magnetic fields may be configured to be sufficiently strong so as to finely align the platform 12 with the base 10. According to one embodiment, a combination of attracting and repelling magnets may be used to increase the precision of the alignment.

According to various other embodiments, the device may be configured such that the punch 14 remains stationary relative to the base 10, and the sheet of material is coupled to the platform 12. Accordingly, the detent and locating elements and portions described above may be use to locate the sheet of material relative to the base, and thus the punch.

References to "front," "back," "rear," "upward," "downward," "top," "beneath," "inner," "outer," "right," and "left" in this description are merely used to identify the various elements as they are oriented in the Figures. These terms are meant to assist the reader in understanding the embodiment illustrated, and are not meant to limit the element which they describe, as the various elements may be oriented differently in various embodiments.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

The construction and arrangement of the elements of the device for forming a pattern in a material as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents, but also equivalent structures. Other substitutions, modifications, changes, and omissions may be made in the design, operating configuration, and arrangement of the preferred and other exemplary embodiments without departing from the scope of the appended claims.

What is claimed is:

1. A device for forming a pattern in a sheet of material, comprising:

a base including:

a first locating portion, the first locating portion providing a first position; and a second locating portion, the second locating portion providing a second position;

a platform coupled to the base and moveable between the first position and the second position, the platform including:

a locating element configured to engage the first locating portion when the platform is in the first position and to engage the second locating portion when the platform is in the second position, respectively; and an actuator including a lever having a first portion and a second portion, the first portion configured to move a punch supported by the platform into contact with the sheet of material when the actuator is actuated, and the second portion configured to cause the locating element to engage the locating portion when the actuator is actuated;

wherein when the platform is proximate the first position, the locating element provides fine location of the platform in the first position relative to the base by engaging the first locating portion, and when the platform is proximate the second position, the locating element provides fine location of the platform in the second position relative to the base by engaging the second locating portion.

2. The device of claim 1, wherein the punch is moveable between a reset position and a depressed position; and wherein the punch forms a pattern in the sheet of material when the punch moves from the reset position to the depressed position and the sheet of material is present proximate the depressed position.

3. The device of claim 2, wherein the first locating portion and the second locating portion are spaced apart such that the pattern formed in the sheet material by the punch when the platform is in the second position is continuous with the pattern formed in the sheet material by the punch when the platform is in the first position.

4. The device of claim 1, wherein the locating element is at least one pin slidably coupled to the platform between a first state and a second state; and wherein when the at least one pin is in the first state, the locating element does not engage the locating portion, and when the at least one pin is in the second state, the locating element engages the locating portion.

5. The device of claim 4, wherein the locating portion defines at least one hole;

and wherein when the at least one pin is in the first state a first end of the pin is retracted into the platform, and when the at least one pin is in the second state the first end of the pin extends from the platform into the at least one hole.

6. The device of claim 5 wherein the at least one pin comprises:

a first pin; and a second pin laterally spaced a first distance from the first pin; and wherein the at least one hole comprises:

a first hole; and a second hole laterally spaced the first distance from the first hole.

7. The device of claim 1, wherein the lever includes a cam surface; and wherein the locating element is slidably coupled to the platform, the locating element including a first end configured to follow the cam surface and a second end configured to engage the locating portion.

8. The device of claim 1, wherein the base further includes:

a first detent portion; and a second detent portion spaced apart from the first detent portion; and wherein a detent element of the platform engages the first detent portion when the platform is proximate the first position, thereby providing coarse indication of proximity to the first position, and wherein the detent element engages the second detent portion when the platform is proximate the second position, thereby providing coarse indication of proximity to the second position; and wherein the locating element is configured to provide fine location of the platform in the second position relative to the base by engaging the second locating portion.

9. A device for forming a pattern in a sheet of material, comprising:

a base including:

a first locating portion, the first locating portion providing a first position; and a second locating portion, the second locating portion providing a second position;

a platform coupled to the base and moveable between the first position and the second position, the platform including:

a locating element configured to engage the first locating portion when the platform is in the first position and to engage the second locating portion when the platform is in the second position, respectively; and an actuator including a first portion and a second portion, the first portion of the actuator configured to move a punch supported by the platform into contact with the sheet of material when the actuator is actuated, and the second portion configured to cause the locating element to engage the locating portion when the actuator is actuated;

wherein when the platform is proximate the first position, the locating element provides fine location of the platform in the first position relative to the base by engaging the first locating portion, and when the platform is proximate the second position, the locating element provides fine location of the platform in the second position relative to the base by engaging the second locating portion; and wherein the actuator comprises a handle rotatably coupled to the platform, the handle including a cam surface, and wherein the locating element is slidably coupled to the platform, the locating element including a first end configured to follow the cam surface and a second end configured to engage the locating portion.

10. The device of claim 9, wherein the punch is moveable between a reset position and a depressed position; and wherein the punch forms a pattern in the sheet of material when the punch moves from the reset position to the depressed position and the sheet of material is present proximate the depressed position.

11. The device of claim 10, wherein the first locating portion and the second locating portion are spaced apart such that the pattern formed in the sheet material by the punch when the platform is in the second position is continuous with the pattern formed in the sheet material by the punch when the platform is in the first position.

12. The device of claim 9, wherein the locating element is at least one pin slidably coupled to the platform between a first state and a second state; and wherein when the at least one pin is in the first state, the locating element does not engage the locating portion, and when the at least one pin is in the second state, the locating element engages the locating portion.

13. The device of claim 12, wherein the locating portion defines at least one hole; and wherein when the at least one pin is in the first state a first end of the pin is retracted into the platform, and when the at least one pin is in the second state the first end of the pin extends from the platform into the at least one hole.

14. The device of claim 13, wherein the at least one pin comprises:

a first pin; and a second pin laterally spaced a first distance from the first pin; and wherein the at least one hole comprises:

a first hole; and a second hole laterally spaced the first distance from the first hole.

15. A device for forming a pattern in a sheet of material, comprising:

a base including:

a first locating portion, the first locating portion providing a first position;

a second locating portion, the second locating portion providing a second position;

a first detent portion; and a second detent portion spaced apart from the first detent portion;

a platform coupled to the base and moveable between the first position and the second position, the platform including:

a locating element configured to engage the first locating portion when the platform is in the first position and to engage the second locating portion when the platform is in the second position, respectively; and an actuator including a first portion and a second portion, the first portion of the actuator configured to move a punch supported by the platform into contact with the sheet of material when the actuator is actuated, and the second portion configured to cause the locating element to engage the locating portion when the actuator is actuated;

wherein when the platform is proximate the first position, the locating element provides fine location of the platform in the first position relative to the base by engaging the first locating portion, and when the platform is proximate the second position, the locating element provides fine location of the platform in the second position relative to the base by engaging the second locating portion;

wherein a detent element of the platform engages the first detent portion when the platform is proximate the first position, thereby providing coarse indication of proximity to the first position, and wherein the detent element engages the second detent portion when the platform is proximate the second position, thereby providing coarse indication of proximity to the second position.

16. The device of claim 15, wherein the punch is moveable between a reset position and a depressed position; and wherein the punch forms a pattern in the sheet of material when the punch moves from the reset position to the depressed position and the sheet of material is present proximate the depressed position.

17. The device of claim 16, wherein the first locating portion and the second locating portion are spaced apart such that the pattern formed in the sheet material by the punch when the platform is in the second position is continuous with the pattern formed in the sheet material by the punch when the platform is in the first position.

18. The device of claim 15, wherein the locating element is at least one pin slidably coupled to the platform between a first state and a second state; and wherein when the at least one pin is in the first state, the locating element does not engage the locating portion, and when the at least one pin is in the second state, the locating element engages the locating portion.

19. The device of claim 18, wherein the locating portion defines at least one hole; and wherein when the at least one pin is in the first state a first end of the pin is retracted into the platform, and when the at least one pin is in the second state the first end of the pin extends from the platform into the at least one hole.

20. The device of claim 19, wherein the at least one pin comprises:

a first pin; and a second pin laterally spaced a first distance from the first pin; and wherein the at least one hole comprises:

a first hole; and a second hole laterally spaced the first distance from the first hole.

* * * * *